US007377888B2

(12) United States Patent
Godbold

(10) Patent No.: US 7,377,888 B2
(45) Date of Patent: May 27, 2008

(54) PUSHUP EXERCISE DEVICE

(76) Inventor: Temico R. Godbold, 2258 N. Broad St., Philadelphia, PA (US) 19132

( * ) Notice: Subject to any disclaimer, the term of this patent is extended or adjusted under 35 U.S.C. 154(b) by 0 days.

(21) Appl. No.: 11/249,560

(22) Filed: Oct. 13, 2005

(65) Prior Publication Data

US 2006/0040809 A1 Feb. 23, 2006

Related U.S. Application Data

(63) Continuation-in-part of application No. 10/891,645, filed on Jul. 15, 2004, now abandoned.

(51) Int. Cl.
*A63B 26/00* (2006.01)

(52) U.S. Cl. ..... 482/141; 482/44

(58) Field of Classification Search ..... 482/141, 482/62, 44–50; D21/662, 665
See application file for complete search history.

(56) References Cited

U.S. PATENT DOCUMENTS 4,548,092 A * 10/1985 Strong, Jr. ..... 74/473.14
4,610,448 A * 9/1986 Hill ..... 482/141
4,768,778 A * 9/1988 Thomas, Jr. ..... 482/141
4,858,912 A * 8/1989 Boyd ..... 482/45
5,713,823 A * 2/1998 Walendzak et al. ..... 482/142
6,086,518 A * 7/2000 MacCready, Jr. ..... 482/44
6,129,651 A * 10/2000 Denaro ..... 482/141

* cited by examiner

*Primary Examiner*—Lori Amerson
(74) *Attorney, Agent, or Firm*—Joseph M. Konieczny, Sr.

(57) ABSTRACT

Rotatable hand supports for performing advanced pushups on a floor or ground surface. The main handle of the supports has a grip portion constructed to be grasped by a user. The base has a bottom portion adapted to contact the floor, a top portion rotatably connected to the bottom portion, and a bearing assembly supporting the top portion on said bottom portion. A support connects the handle to the top portion of the base and supports the handle at an elevated position relative to the base and above the floor. A hand clutch extends from the main handle and can be squeezed to perform hand-grip exercises simultaneously with a pushup exercise.

20 Claims, 11 Drawing Sheets

PUSHUP EXERCISE DEVICE

This is a continuation-in-part application of U.S. patent application Ser. No. 10/891,645 filed on Jul. 15, 2004 entitled Pushup Exercise Device.

FIELD OF THE INVENTION

The present invention relates to an exercise device for performing pushups. More particularly, the present invention relates to hand supports having hand grips that are elevated and rotatable relative to the floor so that the user's comfort is improved and range of motion is extended while performing pushups.

BACKGROUND OF THE INVENTION

The conventional pushup exercise has traditionally been used for strengthening arm muscles. A conventional pushup is performed by lying face down with palms to the floor and by pushing the body up and down with the arms.

Many types of handgrip devices are known for performing pushups. For example, Acs et. al, U.S. Pat. No. 3,115,338, disclose handles that are rigidly supported on stationary bases. The handles assist the user performing pushups by providing a more adaptable and natural hand gripping position. The handles allow the user to keep a straight wrist rather than a bent wrist. The handles also elevate the user's hands relative to the floor, thereby increasing the range of motion through which the user moves during the pushup exercise.

Other handgrip devices provide additional features to improve the muscle conditioning effect of performing pushups. For example, Swisher, U.S. Pat. No. 5,205,802, provides an elongate, elevated base and two hand grips. The invention allows the user to adjust the lateral space between grips for maximum comfort and to vary the range of motion of the exercise. Further, the hand grips are rotatable so that the user can rotate his hands and wrists through a mechanically limited range of motion.

Hill, U.S. Pat. No. 4,610,448, also discloses hand grips for performing pushups. The hand grips allow the user to rotate his hand about a horizontal axis in order to position the wrist at a comfortable position, and about a vertical axis in order to simultaneously rotate the arm while extending and contracting it.

Several of the devices in the prior art allow the user to rotate his hands about a vertical axis while performing pushups. Such devices comprise rotatably-connected, planar plates that are arranged in contact with one another. To rotate such devices, the user must overcome the frictional force between the plates, which may be excessive depending on the upper body weight of the user and the coefficient of friction between the plates. Further, rotation of the device may not be smooth due to variations in the force required to initiate rotation compared to the force required to maintain rotation. Therefore, it would be desirable to provide hand supports that can be easily and smoothly rotated about a vertical axis while performing pushups.

Several of the pushup devices in the prior art provide a handle having a cylindrical profile, which may be comfortable for some users but uncomfortable for others. Therefore, it would be desirable to provide a pushup device that has a plurality of interchangeable handles having grip profiles that are different from one another.

In the prior art, the various pushup devices vary greatly in size and complexity. However, even the smallest devices are prohibitively large to conveniently travel with in a briefcase, handbag or small luggage. Therefore, it would be desirable to provide a pushup device that is easily collapsible to a compact size so that the user can comfortably travel with the device.

SUMMARY OF THE INVENTION

The present invention provides hand supports for performing pushups on a floor or ground surface. The hand supports can be easily and smoothly rotated about a vertical axis while performing pushups. The hand supports generally comprise a handle, a rotatable base, and handle support.

In a first embodiment, the handle has first and second ends, and an intermediate grip portion adapted to be grasped by a user. The support connects the handle to the top portion of the base and supports the handle at an elevated position relative to the base and-above the floor. The support may comprise a U-shaped bracket having a base and a pair of arms. The base and arms may be integrally formed. In one embodiment, at least one support arm is fixed at one end to the top portion of the base and connected at the other end to the handle. In another embodiment, each arm is fixed at one end to the top portion of the base and at the other end to opposed ends of the handle.

The base has a bottom portion adapted to contact the floor, a top portion rotatably connected to the bottom portion, and a bearing assembly supporting the top portion on the bottom portion. Preferably, each of the top and bottom base portions comprises a generally-planar, circular base plate having a central portion and an outer annular lip. The plates are connected by a central shaft and arranged with the annular lips facing one another. The plates and lips define an internal cavity intermediate the plates.

The bearing assembly comprises a plurality of bearings and cage arranged in the internal cavity between the plates. The bearings separate and support the top plate relative to the bottom plate. The bearings having a diameter large enough to prevent the lips of the top and bottom plates from contacting one another. At least one of the base plates may include a race formed on the internal cavity side so that the bearings may travel in the race.

In another embodiment of the invention, the device has a plurality of handles having grip profiles that are different from one another. The handles are interchangeable with one another. In this embodiment, the handles may also have quick connect/disconnect fasteners.

In a further embodiment of the invention, the device may include an angular position indicator for measuring angular rotation of the handle relative to the bottom portion of the base. The angular position indicator may comprise a pointer and a calibrated dial. The pointer is preferably axially-aligned with the axis of the handle.

In yet another embodiment of the invention, the device is easily collapsible to a compact size so that the user can comfortably travel with the device. The handle support is movable from a first, extended position supporting the handle at an elevated position relative to the base, and a second collapsed position. In this embodiment, the support preferably includes a hinge connecting the support to the upper portion of the base so that the support is rotatable between a first extended position, and a second position generally co-planar with the base.

In a further embodiment, both arms of the support are pivotally connected by hinges to the base. In this embodiment, the handle prevents the support from collapsing from the first to the second position when the handle is connected to the base. When the handle is disconnected from the support, the support is freely collapsible. In this embodiment, the first arm is hinged to the top portion of the base and movable to a collapsed position coplanar and overlapping the top portion of the base. The second arm is bifurcated into two segments. The first segment is fixed to the base portion. The second segment is hinged to the first segment and movable to a collapsed position coplanar and overlapping the first arm. Alternatively, at least one support arm is connected to the top portion of the base by a tongue and groove connector.

In still a further embodiment, the device also includes a hand clutch that can be grasped and moved between first and second limit positions by squeezing with the user's fingers. Hand clutch bias means resist movement of the hand clutch from the first limit position to the second limit position.

In one embodiment, the hand clutch is pivotally-connected to the main handle, and the clutch bias means normally urges the hand clutch away from the main handle. In a preferred embodiment, the hand clutch bias means can be adjusted to change the force needed to move the clutch between limit positions. The clutch bias means includes a spring tensioner and at lease one of a compression spring and torsion spring. Additionally, the device includes means for adjusting at least one of said limit positions.

The pushup device also includes a base bias means for resisting rotational movement of the top base in either a clockwise or counter-clockwise direction. The pushup device may also include an adjustable stop for locking the top base plate in at least one predetermined angular location.

In one embodiment, the hand clutch includes a grip handle that is removable and can be interchanged with a second grip handle having a different shape or size. The grip handles include quick connect/disconnect fasteners.

The pushup device may also include a counter for recording and displaying the number of exercise repetitions performed by the user. The counter may include an interface on for downloading data from the counter to the user's computer.

DETAILED DESCRIPTION OF PREFERRED EMBODIMENTS

Figure 1:
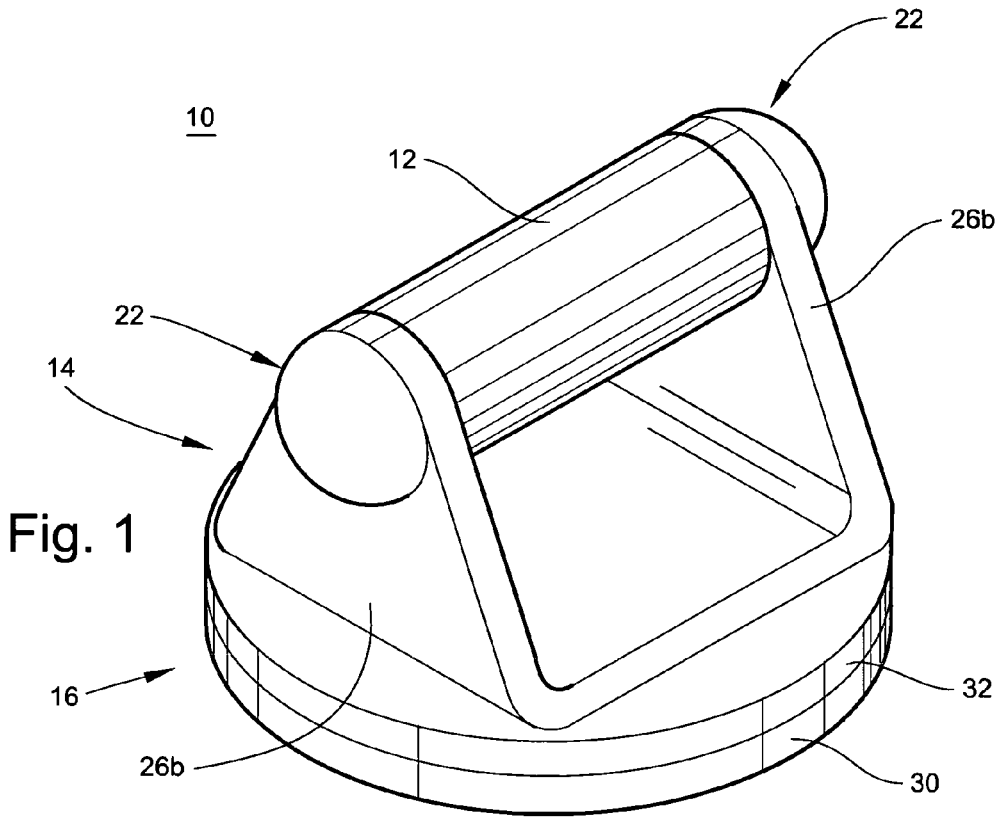
FIG. 1 is an isometric view of a device for performing pushups in accordance with an embodiment of the invention.

For the purpose of illustrating the invention, there is shown in the accompanying drawings several embodiments of the invention. However, it should be understood by those of ordinary skill in the art that the invention is not limited to the precise arrangements and instrumentalities shown therein and described below.

The pushup device in accordance with preferred embodiments of the present invention is illustrated in FIGS. 1-24 wherein like reference numerals are used throughout to designate like elements.

A first embodiment of the pushup device, designated generally by reference numeral 10, is shown in FIGS. 1-4. The pushup device 10 generally comprises a handle 12, a rotatable base 16, and a support assembly 14 that connects the handle 12 to the base 16 and supports the handle 12 at an elevated position relative to the base 16. The handle 12 is constructed to be grasped by the user. The base 16 is constructed to rest on the floor or other support surface.

In the embodiment shown in FIGS. 1-4, the handle 12 comprises a solid, cylindrical bar segment, which is made of a strong, rigid material such as wood, plastic, metal or the like. The handle 12 preferably has an axial length slightly larger than the width of an adult human hand and a diameter that allows an adult human to comfortably grasp the handle 12 while performing pushups. For example, the handle 12 may be about 4½ inches long and about 1½ inches in diameter. However, it should be appreciated that the dimensions of the handle 12 may be reduced or enlarged to accommodate users of all ages and sizes.

A threaded bore 20 extends axially into each end of the handle 12. The bores 20 are arranged to receive removable fasteners 22, which removably secure the handle 12 to the support 14. In a preferred embodiment, the fasteners comprise bolts having enlarged heads 24 so the user can install and tighten the fasteners by hand. The removable fasteners allow the handle 12 to be disassembled from the device without damaging or permanently altering the device.

In the embodiment illustrated in FIGS. 1-4, the fasteners 22 have threaded shanks 23, which cooperatively engage the threaded bores 20 in the handle 12. In one embodiment, the threads 23 on one fastener 22 may have an opposite rotation than the other fastener 22. In other words, clockwise rotation tightens one fastener 22 while counterclockwise rotation tightens the other fastener 22. This construction makes the handle 12 self-locking by rotation about the lengthwise axis of the handle 12. Also, the user may tighten the handle 12 more snugly by rotating the handle 12 with his full hand rather than by rotating the fasteners with his fingers.

As seen in FIGS. 1-4, the fasteners 22 may have rounded heads 24 to prevent injury to the user. Alternatively, the fastener heads 24 could have a finite number of sides, such as a hex head, or have a knurled peripheral surface for easier rotation by hand. Alternatively, the fastener heads 24 could have a slotted or socketed end for installation with a tool.

Figure 2:
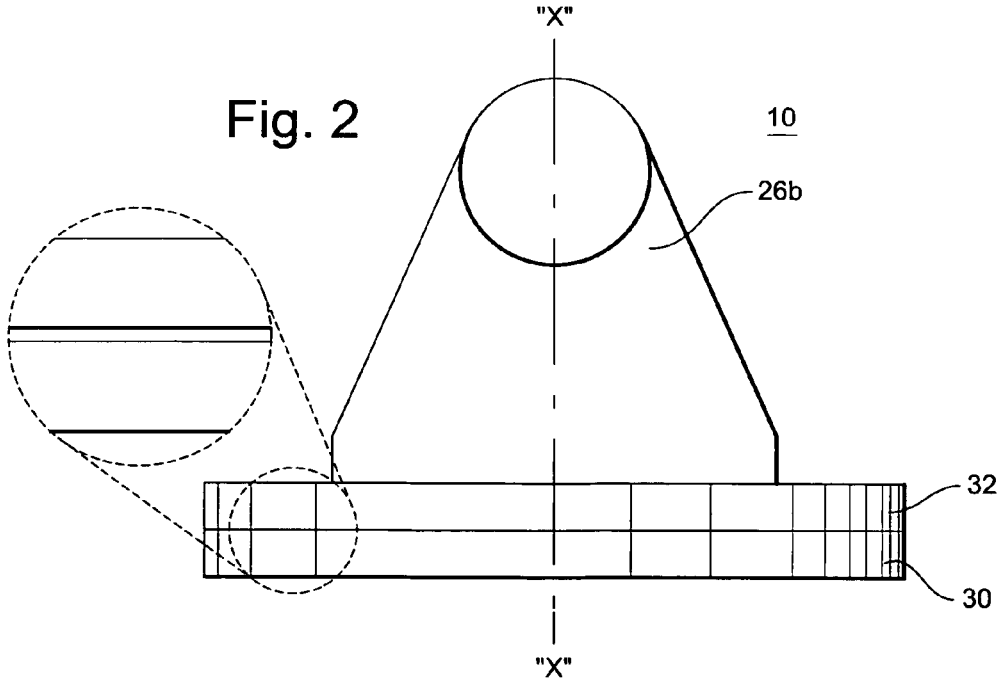
FIG. 2 is a side elevational view of the device show in FIG. 1.
Figure 3:
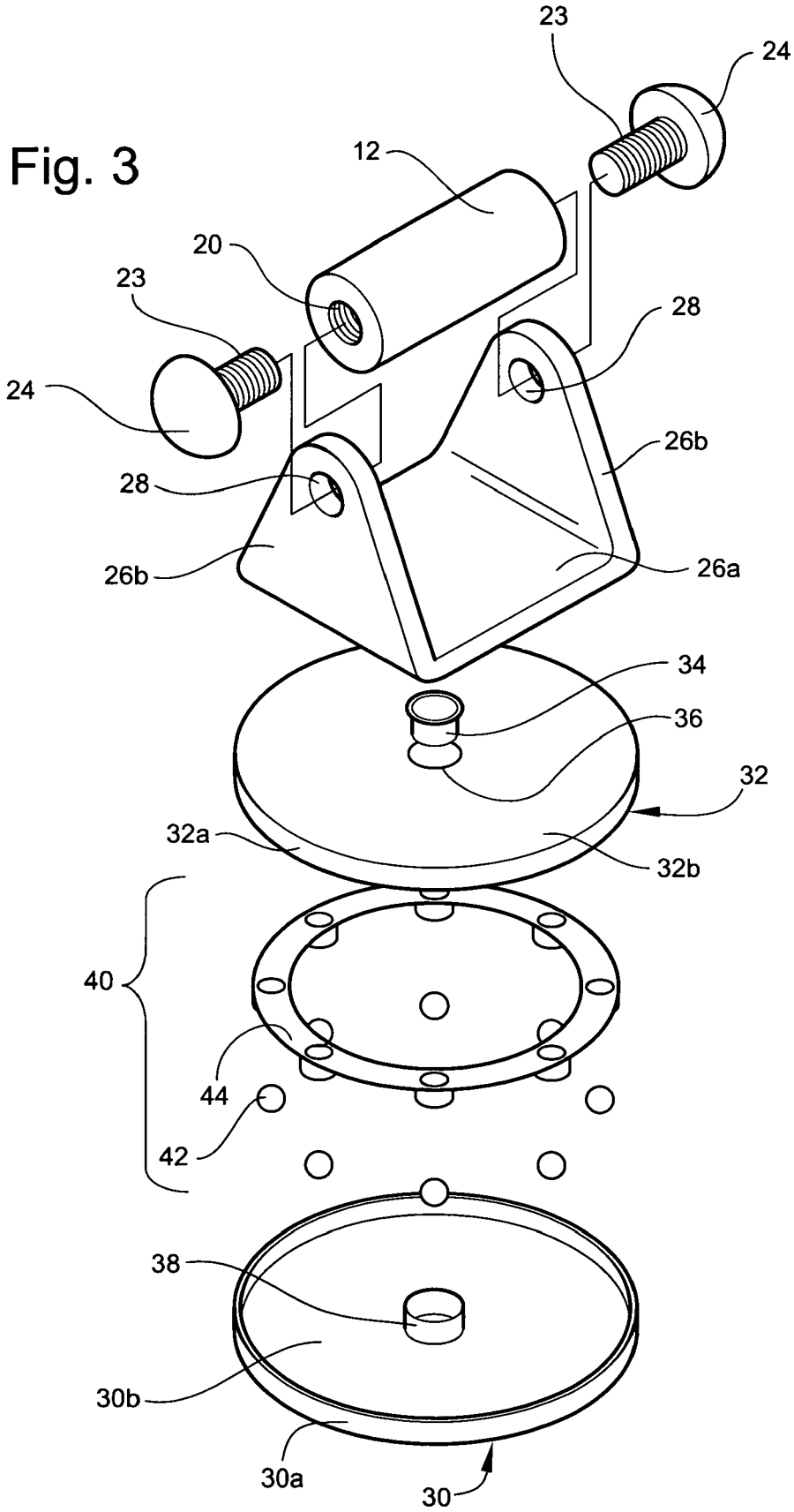
FIG. 3 is an exploded isometric view of the device shown in FIG. 1.
Figure 4:
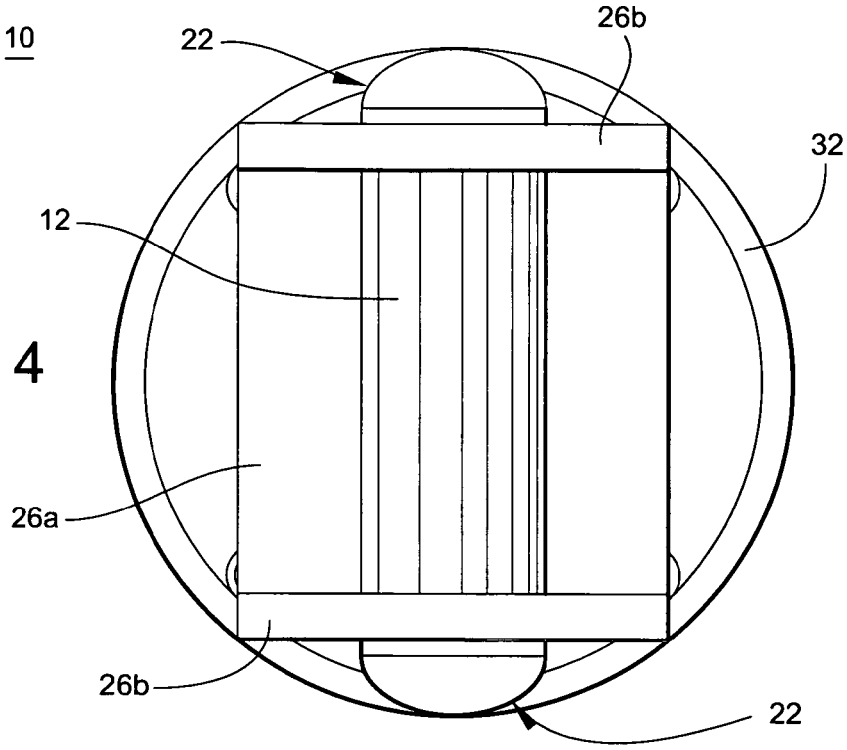
FIG. 4 is a top plan view of the device show in FIG. 1.
Figure 6:
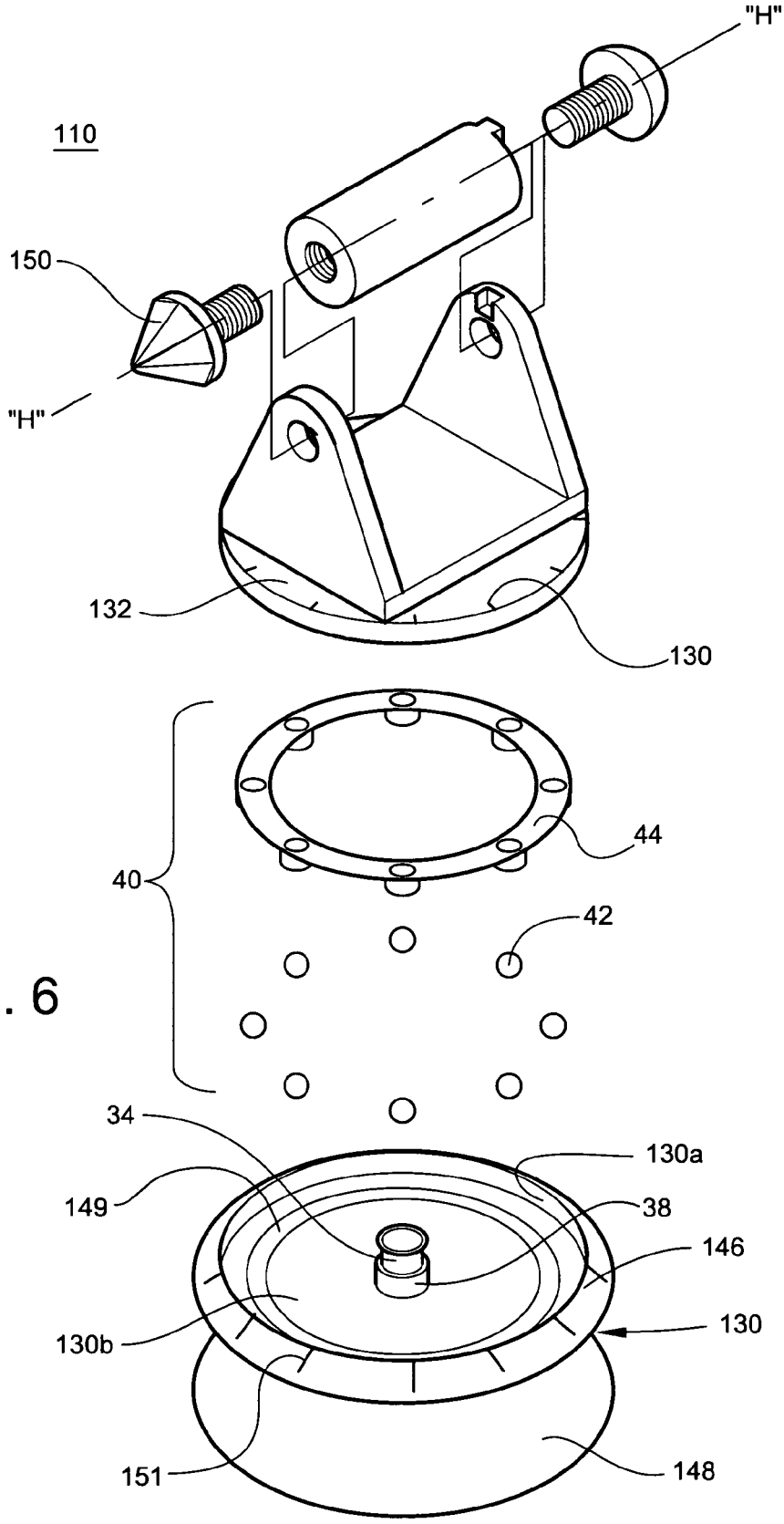
FIG. 6 is an exploded isometric view of the device shown in FIG. 5.

Referring to FIGS. 1 and 3, the support assembly 14 comprises a U-shaped bracket 26, having a central base 26*a* and a pair of arms 26*b*, 26*c*. In the embodiment illustrated in FIGS. 1-4, the arms 26*b*, 26*c* and base 26*a* are integrally formed from a single piece of strong, rigid material such as plastic or metal. Alternatively, the arms 26*b*, 26*c* and base 26*a* of the bracket 26 could be fabricated as separate components, which are adhered or otherwise fastened together such as shown in FIG. 6.

In a preferred embodiment, the arms 26*b*, 26*c* of the bracket 26 have an upwardly-tapering or triangular shape, which provides a strong connection interface with the base 26*a* and sufficient hand and wrist clearance near the handle 12. An aperture 28 extends through each arm proximate the apex. The apertures 28 align with the threaded bores 20 in the handle 12. The bracket 26 is fastened to the top side of the top plate 32 of the base 16 by adhesives, screws or other fastening means.

The rotatable base 16 has a bottom portion adapted to contact the floor or other support surface, and a top portion that is freely rotatable relative to the bottom portion. The bottom and top portions comprise generally-planar, circular plates 30, 32, respectively. Each plate 30, 32 has a central portion 30*b*, 32*b* and an outer, annular lip 30*a*, 32*a*, which is preferably integrally formed with the central portion 30*b*, 32*b* of the plates. The plates 30, 32 are made from a strong, rigid material such as metal or plastic.

The plates 30, 32 are rotatably connected by a shaft 34, which extends through a central aperture 36 in the top plate 32 and connects to a central, axially-aligned socket 38 in the bottom plate 30. The plates 30, 32 are arranged with the annular lips 30*a*, 32*a* facing one another so that an internal cavity is formed intermediate the plates 30, 32.

A bearing assembly 40 is arranged in the internal cavity between the plates 30, 32. The bearing assembly 40 supports the top plate 32 and enables the top plate 32 to rotate freely and smoothly relative to the bottom plate 30. In a preferred embodiment, the bearing assembly 40 comprises a plurality of ball bearings 42 and cage 44. The diameter of the ball bearings 42 is large enough to prevent the lips 30*a*, 32*a* of the bottom and top plates 30, 32 from contacting one another, but small enough so that the bearing assembly 40 can not slide laterally-outwardly through the small gap "G" between the lips 30*a*, 32*a*, as best seen in FIG. 2. Preferably, the diameter of the cage 44 is slightly smaller than the diameter of the central portion 30*b*, 32*b* of the plates. The bearings 42 should be sufficient in number to support the upper body weight of the user without unduly restricting the ease with which the handle 12 can be rotated during the exercise.

Further embodiments of the invention are described in FIGS. 5-11, wherein elements similar to the elements described above share the same reference numeral but with an additional integer prefix.

Figure 5:
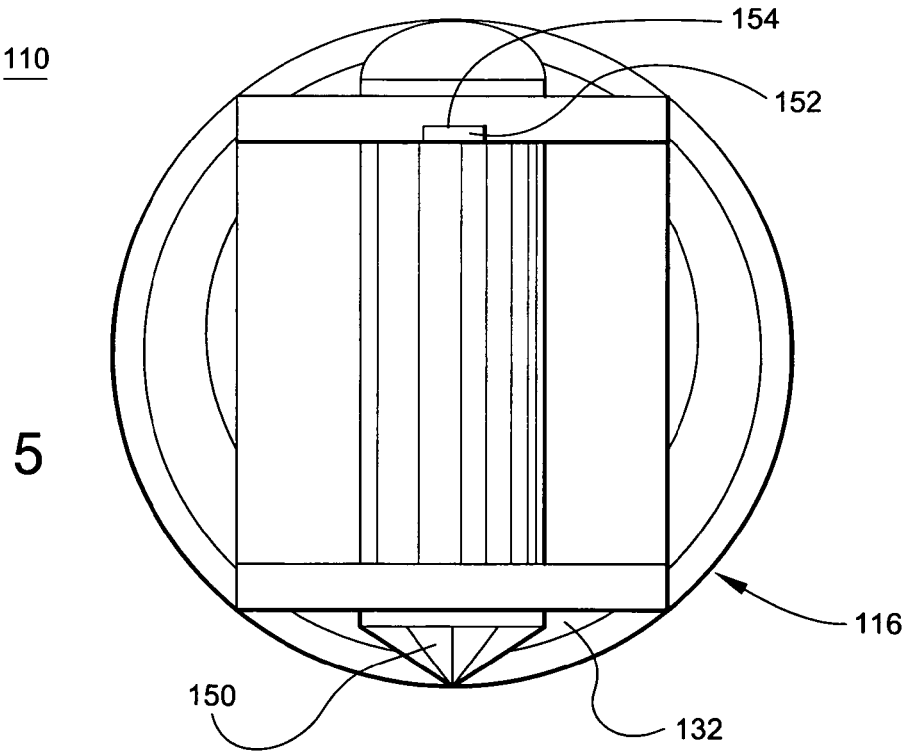
FIG. 5 is a top plan view of a device for performing pushups in accordance with another embodiment of the invention.

An alternative embodiment of the invention having additional novel features is shown in FIGS. 5 and 6. The device 110 is similar in construction to the device disclosed in FIGS. 1-4. However, the device 110 has a wider base, an anti-skid base pad, an angular position indicator so that the user can accurately measure the degree of rotation of the handle 112, and a key that prevents the handle 112 from rotating about its longitudinal axis.

Referring to FIG. 6, the bottom plate 130 has a central portion 130*b*, an annular lip 130*a*, and an annular, radially-outwardly, downwardly-inclined flange 146, which increases the footprint of the base 116, thereby providing increased stability compared to the device 10 disclosed in FIGS. 1-4. The flange 146 also improves the aesthetic appearance of the device 110.

Referring to FIG. 6, the base 116 may also include an annular race 149 on the surface of the internal central portion 130*b*, 132*b* of one or more of the plates 130, 132. The race 149 helps prevent lateral movement of the plates 130, 132 relative to one another and prevents friction on the shaft 134 without unduly preventing relative rotational movement of the plates 130, 132.

An anti-skid pad 148 is preferably adhered to the bottom of the bottom plate 130. The anti-skid pad 148 is preferably made of a soft, tacky material such as rubber. The anti-skid pad 148 not only prevents the device 110 from sliding on smooth surfaces, but also dampens vibration and noise produced while performing pushups.

The angular position indicator comprises a pointer 150 and a calibrated dial. The pointer 150 is axially-aligned with the longitudinal axis of the handle. As best seen in FIG. 5, the pointer 150 comprises a tapered cap affixed to the head 124 of one of the fasteners 122. The calibrated dial is preferably attached to the bottom base plate 130. In the embodiment shown in FIG. 6, the dial comprises a series of regularly-spaced marks 151 applied to the flange 146 of the base plate 130. Alternatively, the dial may comprise a separate ring, which has regularly spaced marks or serrations, and which is rotatable on the bottom plate 130 so that the pointer can be "zeroed" with the dial.

During pushups, the torque exerted on the handle by the user may overcome the tightening force of the fasteners 122 and cause the handle 112 to rotate. To prevent the handle 112 from rotating about its longitudinal axis "H", the embodiment illustrated in FIGS. 5-6 includes a tab or key 152, which is formed on at least one end of the handle 112. The tab 152 cooperatively engages a slot 154 in the upper portion of one of the arms 126*c*.

Figure 7:
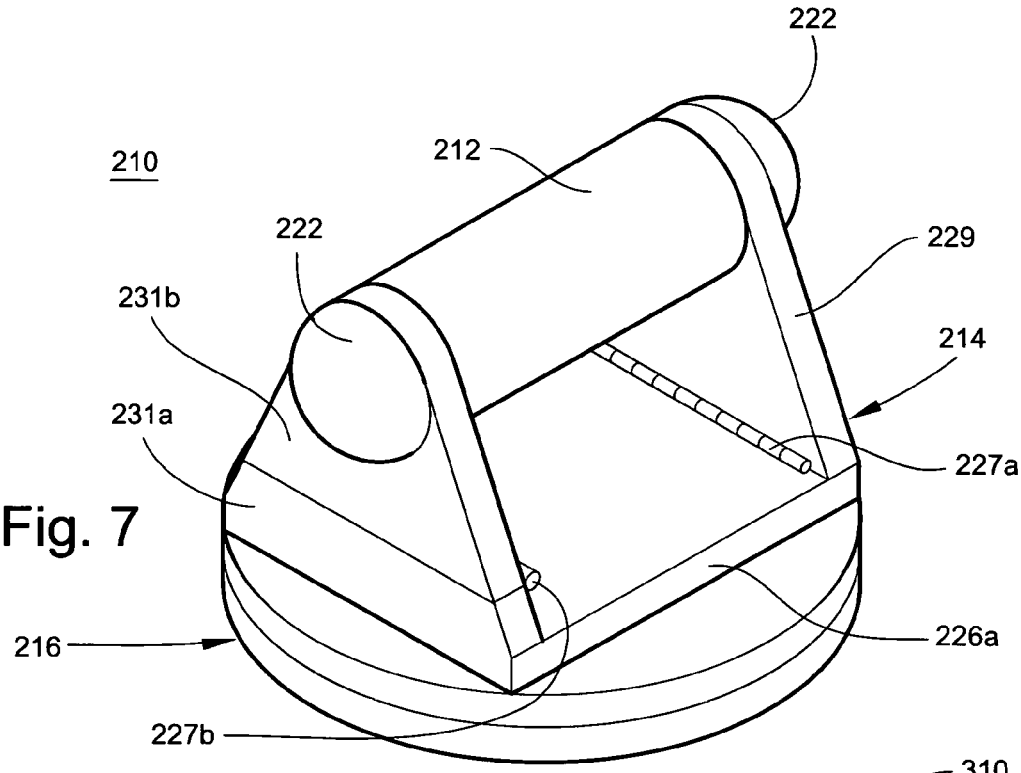
FIG. 7 is an isometric view of a collapsible device for performing pushups in accordance with a further embodiment of the invention.

An additional embodiment of the invention that can be folded or collapsed for more convenient storage or travel is disclosed in FIG. 7. The collapsible device 210 is similar in construction to the device 10 disclosed in FIGS. 1-4, except that the device 210 has a collapsible or foldable handle support 214. In this embodiment, the handle support 214 comprises a U-shaped bracket 226 having a central base 227 and a pair of arms 229, 231. One arm 229 is pivotally connected to the base 227 by a hinge 233*a* so that the bracket arm 229 is movable from a first, upwardly-extending position supporting the handle 212 at an elevated position relative to the base, and a second collapsed position lying flat against and generally coplanar with the base 227.

The second arm 231 is bifurcated into two segments 231*a*, 231*b*. The bottom end of the first segment 231*a* is fixed to the base 227. The second segment 231*b* is pivotally connected to the first segment 231*a* by the second hinge 233*b*, which is similar to the first hinge 233*a*. The first segment 231*b* is short compared to the height of the second segment 231*b*. Preferably, the height of the first segment is slightly larger than the thickness of the first arm 229 to that the second segment 231*b* folds down flat against and generally coplanar with the first arm 229.

The hinges 227 shown in FIG. 7 only permit inward rotation of the arms 229, 231. Once connected to the arms 229, 231, the handle 212 prevents rotation of the arms and locks the support in the first position. To collapse the support 214, the user simply removes the handle 212 and folds downwardly the first arm 229 and then the second segment 231*b* of the second arm 231.

Figure 8:
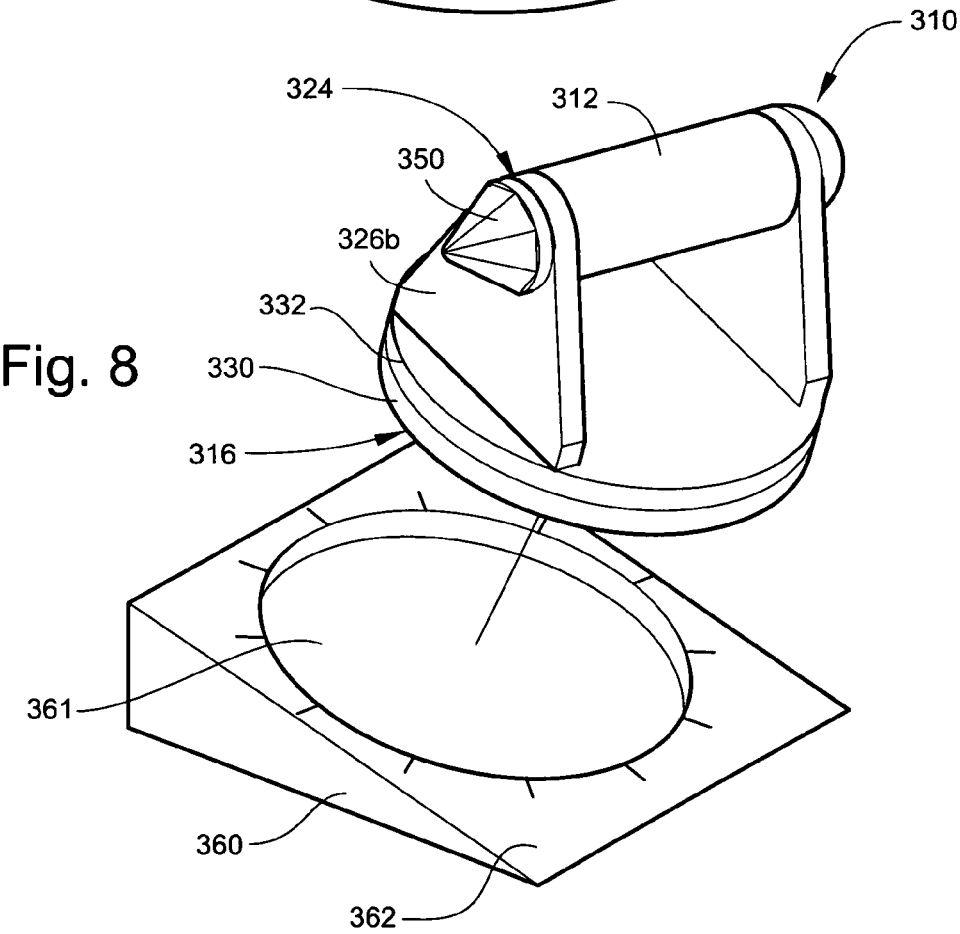
FIG. 8 is an isometric view of a device for performing pushups having an inclined ramp in accordance with another embodiment of the invention.

An additional embodiment of the invention is shown in FIG. 8. In this embodiment, a rotatable pushup device 310 interchanges with an inclined ramp 360. The device 310 is similar in construction to the devices shown in FIGS. 1-7. In this embodiment, the handle support 314 comprises a pair of arms 326 fixed directly to the top plate 332 of the base 316.

The ramp 360 supports and inclines the device 310 at an angle to vary the user's range of motion. The ramp 360 has a socket 361 formed in the inclined surface 362. The socket 361 has a diameter slightly larger than the diameter of the base 316, so that the base 316 fits snugly into the socket 361. The device 310 includes a pointer 350, which registers with a plurality of equally-spaced, angular position marks on the inclined surface proximate the periphery of the socket 361.

In the embodiments shown in FIGS. 1-8, the handle has a basic cylindrical profile. However, in alternative embodiments of the invention, the handle may have an irregularly-shaped profile that is easier to grasp by the user.

Figure 9:
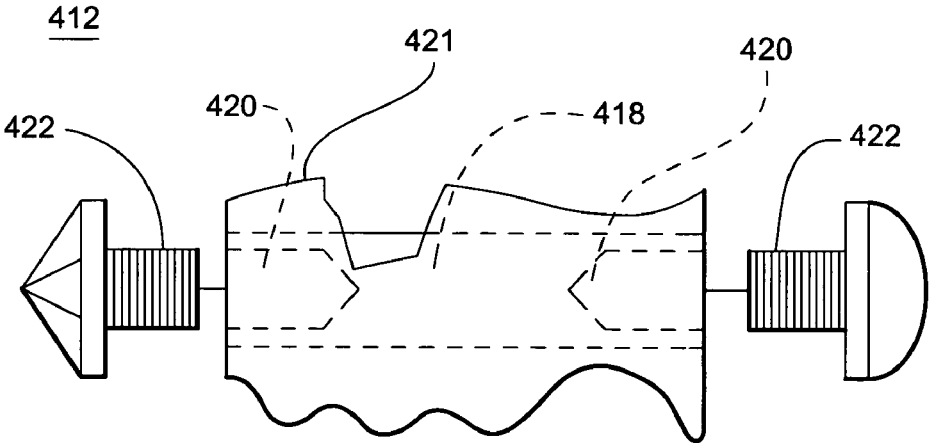
FIG. 9 is a side elevational view in partial section of a handle for use on a pushup device in accordance with embodiments of the invention.

Referring to FIG. 9, the handle 412 comprises a rigid core 418 enveloped by a contoured grip 421. Preferably, the core 418 comprises a cylindrical bar segment, which is made of a strong, rigid material such as wood, plastic, metal or the like. A threaded bore 420 extends axially into each end of the core 418. The bores 420 are constructed to receive threaded fasteners 422, which removably secure the handle 412 to the support of the pushup device. The contoured grip 421 has a profile that allows the user's palm and fingers to grasp the handle 412 more comfortably. Preferably, the contoured grip 421 is made from a deformable material in order to cushion the user's hand.

Figure 10:
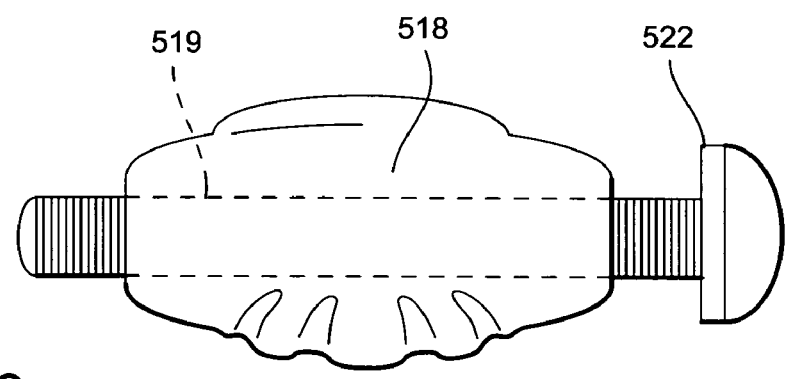
FIG. 10 is a side elevational view of a handle for use on a pushup device in accordance with embodiments of the invention.

In another embodiment shown in FIG. 10, the handle 512 comprises a rigid core 518 that has been formed with a contoured profile. The profile is selected to allow the user's palm and fingers to grasp the handle more comfortably than the cylindrical handle shown in FIGS. 1-4. In this embodiment, the handle 512 is removably fastened to the support with a single, elongate fastener 522 such as a carriage bolt. The fastener 522 extends through a central, axial bore 519 in the handle 512.

Figure 11:
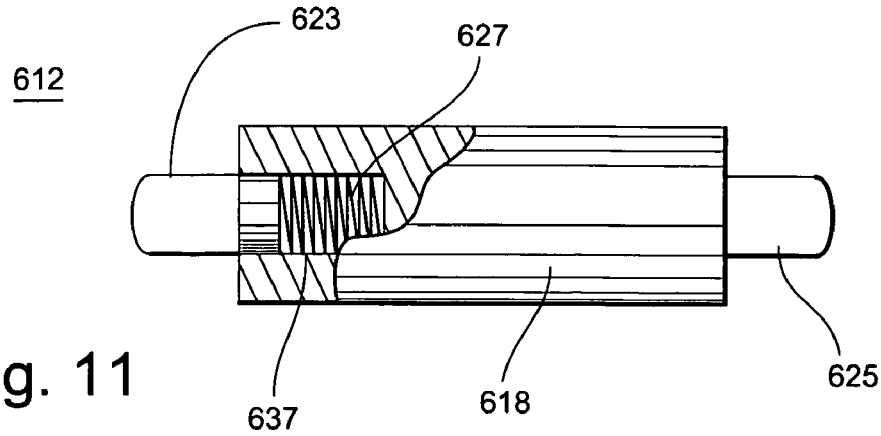
FIG. 11 is a side elevational view in partial section of a handle having a quick connect fastener for use on a pushup device in accordance with embodiments of the invention.

In yet another embodiment shown in FIG. 11, the handle 612 comprises a cylindrical bar segment 618, which is made of a strong, rigid material. Instead of threaded fasteners, the handle 612 has a pair of support pins 665, 667 fixed to opposed ends of the handle 612. The pins are generally co-axial with the longitudinal axis of the segment. At least one of the pins 667 is retractable and has a quick connect/disconnect construction, which more quickly attaches the handle 612 to the support than the threaded fasteners described above. Referring to FIG. 11, the retractable pin 667 comprises a stem 669 that retracts into and extends out from an axial socket 671 in the bar segment 618. The stem 669 is normally biased outwardly to an extended position by an internal compression spring 673.

Figure 12:
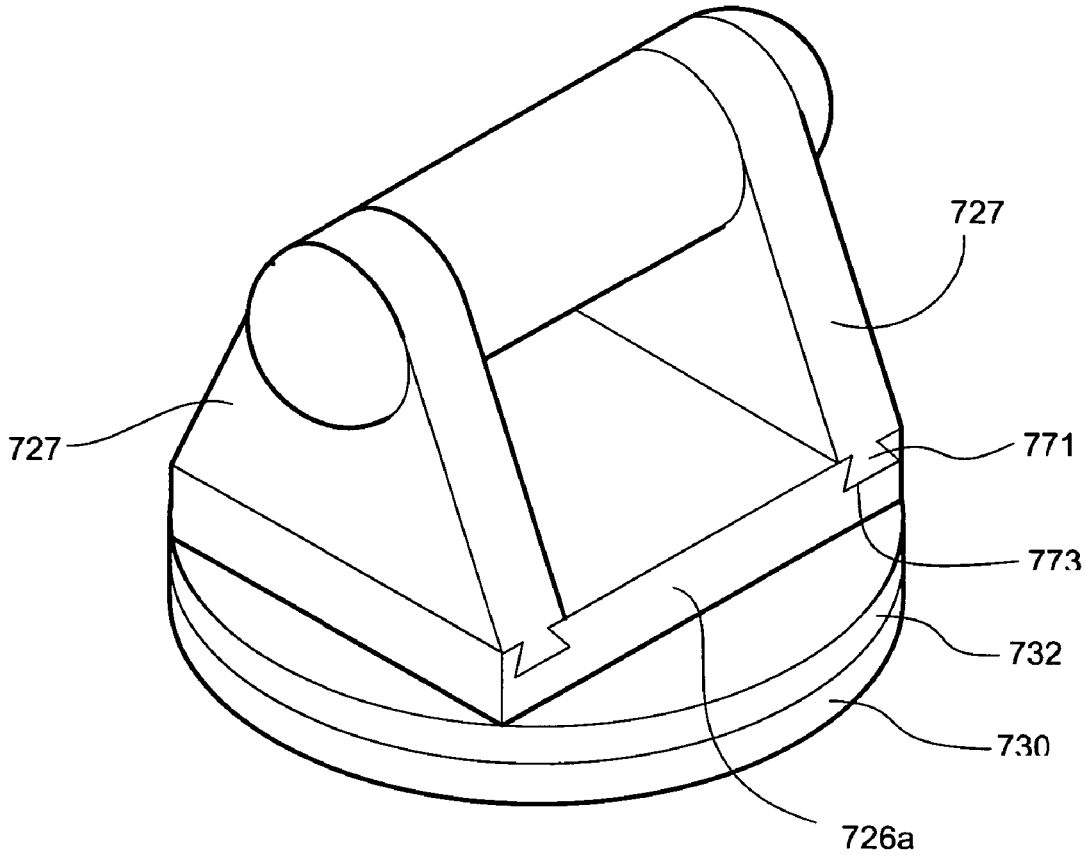
FIG. 12 is an isometric view of a device for performing pushups having a collapsible construction in accordance with a further embodiment of the invention.

An additional embodiment of the invention that can be folded or collapsed for more convenient storage or travel is disclosed in FIG. 12. The collapsible device 710 is similar in construction to the device 10 disclosed in FIGS. 1-4, except that the device 710 has a collapsible or foldable handle support 714. In this embodiment, the handle support 714 comprises a U-shaped bracket 726 having a central base 726*a* and a pair of arms 727. The arms 727 are removably connected to the base 726*a* by a tongue and groove connection. The bottom of each arm 727 has a tongue 771 that slidably engages a groove 773 in the base 726*a*. The bracket 726 is fixed to the upper plate 732 of the base.

The above-described devices are generally used in pairs by initially placing the devices on the floor or other support surface. The user then grasps the handles to perform pushups. During the exercise, the user can easily and smoothly rotate his hands about a vertical axis relative to the floor due to the bearing assembly within the base. The user can thereby stretch and condition the muscles that provide rotary arm movement in addition to strengthening the arm and shoulder muscles in the manner normally achieved by performing traditional pushups.

An additional embodiment of the invention that includes a hand clutch for simultaneously performing a hand-grip exercise is shown in FIGS. 13-20. The pushup device 810 generally comprises a main handle 812, a rotatable base 816, and a support assembly 814 that connects the main handle 812 to the base 816 and supports the main handle 812 at an elevated position relative to the base 816. The main handle 812 is constructed to be grasped by the user. The base 816 comprises a top base plate 832 and bottom base plate 830, and is constructed to rest on the floor or other support surface.

In contrast with the embodiments shown in FIGS. 1-12, in the embodiment shown in FIGS. 13-20, the main handle 812, support assembly 814 and top base plate 832 are integrally formed of a rigid material such as plastic, metal or the like. The main handle 812 has an axial length slightly larger than the width of an adult human hand and a diameter that allows an adult human to comfortably grasp the main handle 812 while performing pushups.

Figure 13:
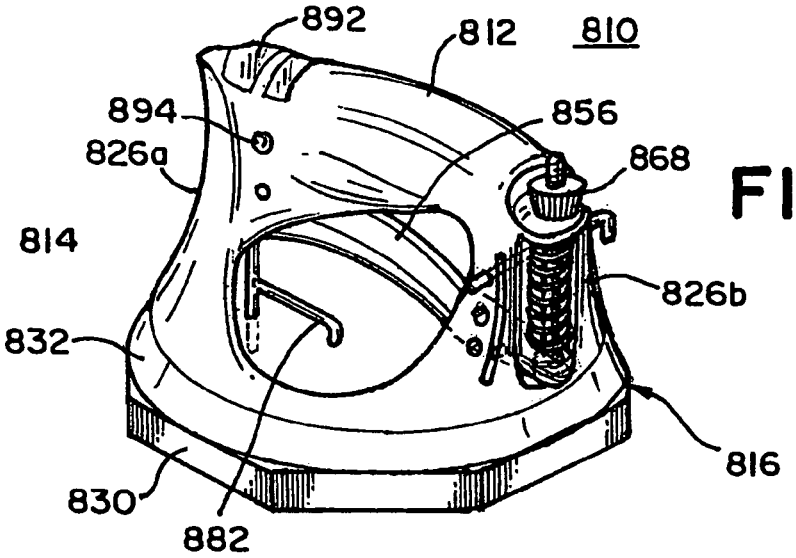
FIG. 13 is a perspective view of a device for performing pushups having a hand clutch in accordance with an additional embodiment of the invention.
Figure 14:
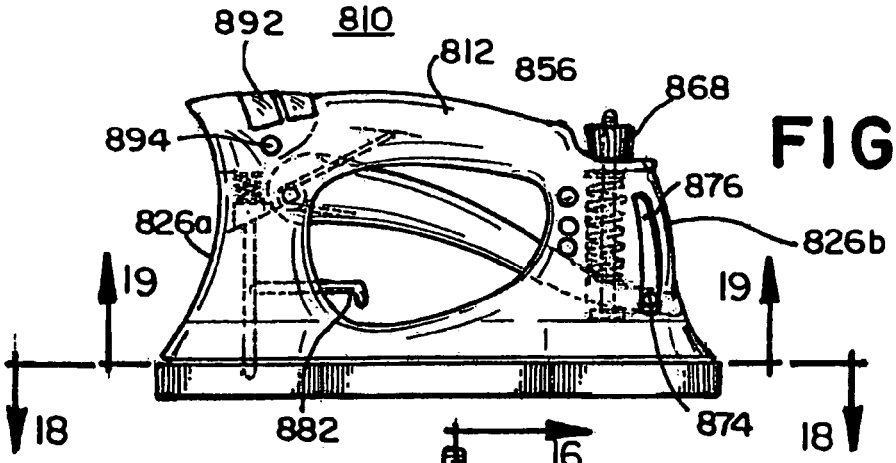
FIG. 14 is a side elevational view of the pushup device shown in FIG. 13.
Figure 15:
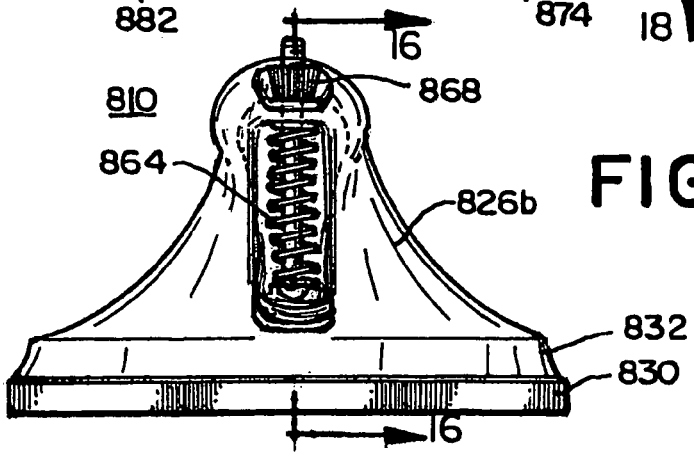
FIG. 15 is a back elevational view of the pushup device shown in FIG. 13.

Referring to FIGS. 13 and 14, the support assembly 814 comprises front 826*a* and back 826*b* support members. In the embodiment illustrated in FIGS. 13-20, the support members 826*a*, 826*b* are integrally formed with the main handle 812 and the top base plate 832. As best seen in FIGS. 13 and 15, the support members 826*a*, 826*b* flare radially outwardly from top to bottom, thereby providing a large connection interface with the top base plate 832 and a solid base of support for the handle 812. The main handle 812 and support members 826*a*, 826*b* have internal cavities which house the components described below.

Similar to the embodiment shown in FIGS. 1-7, the rotatable base 816 has a bottom portion adapted to contact the floor or other support surface, and a top portion that is freely rotatable relative to the bottom portion. The bottom and top portions comprise generally-planar plates 830, 832, respectively. The bottom plate 830 has a central portion

830*b* and an outer, annular lip 830*a*, which is preferably integrally formed with the central portion 830*b*. The plates 830, 832 are made from a strong, rigid material such as metal or plastic.

The plates 830, 832 are rotatably connected by a shaft 834, which extends through a central aperture 836 in the top plate 832 and connects to a central, axially-aligned socket 838 in the bottom plate 830. The top plate 832 includes a plurality of spherical pockets 846 in which ball bearings 842 are seated. The ball bearings 842 support the top plate 832 on the bottom plate 830 and enable the top plate 832 to rotate freely and smoothly relative to the bottom plate 830. The diameter of the ball bearings 842 is large enough to separate the base plates and create an internal cavity intermediate the base plates 830, 832. The bearings 842 should be sufficient in number to support the upper body weight of the user without unduly restricting the ease with which the handle 812 can be rotated during the exercise.

Figure 18:
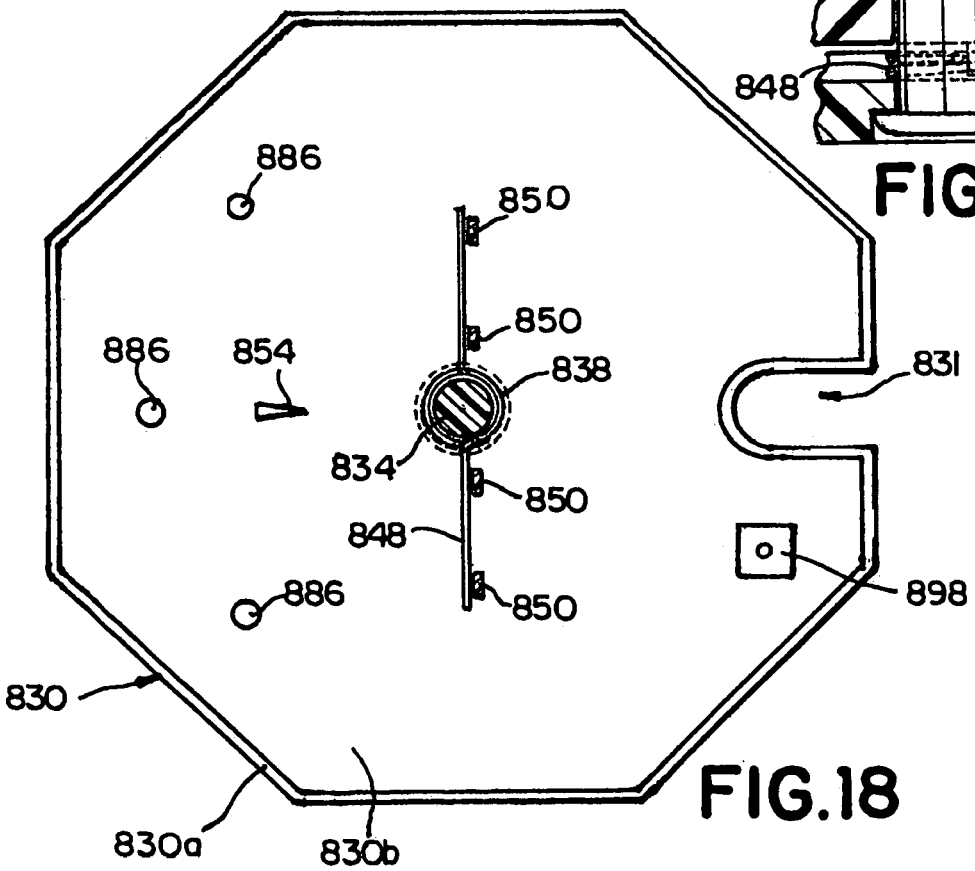
FIG. 18 is a cross-sectional view taken along lines 18-18 of FIG. 14 showing an inside view of the bottom base plate.
Figure 19:
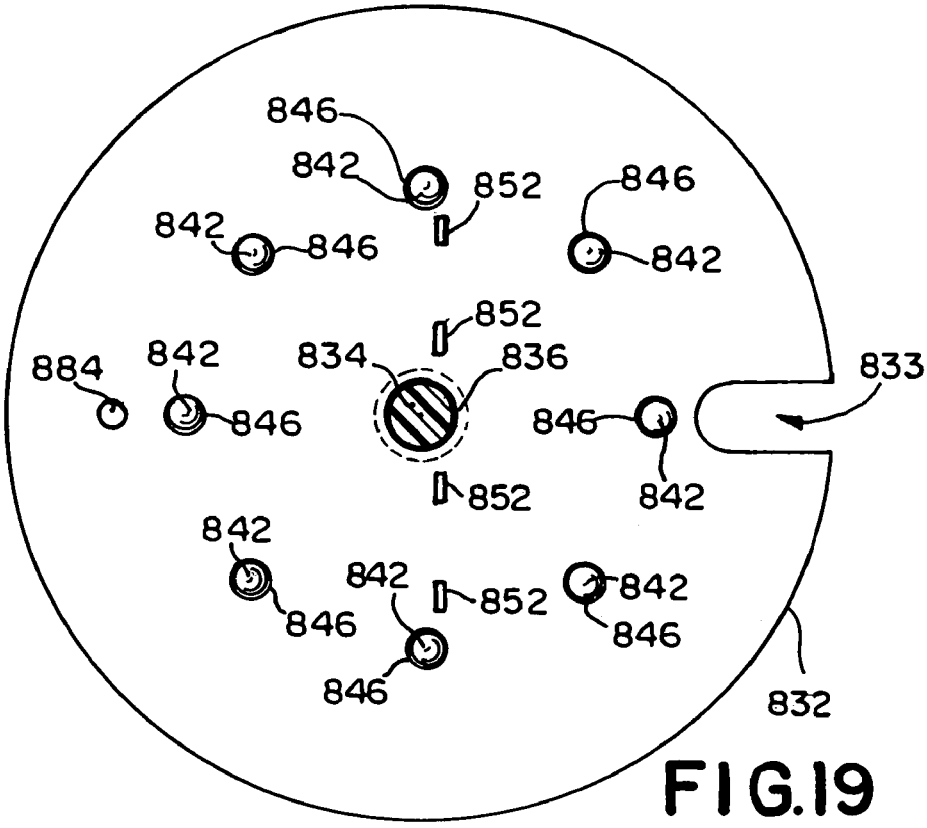
FIG. 19 is a cross-sectional view taken along lines 19-19 of FIG. 14 showing an inside view of the top base plate.
Figure 20:
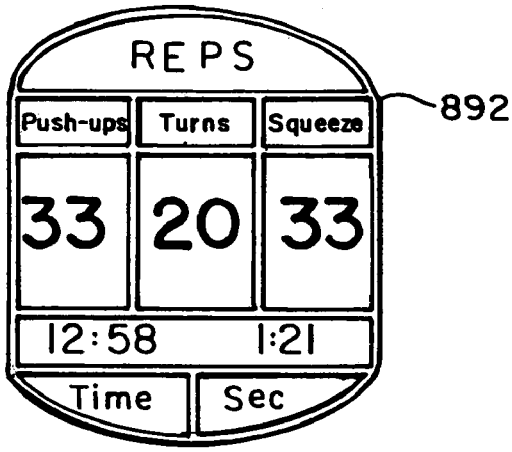
FIG. 20 is schematic view of a counter of the device shown in FIG. 13.

Referring to FIG. 18, a spring 848 surrounds the central shaft 834 and socket 838, and resists rotational movement of the top plate 832 relative to the bottom plate 830. The spring 48 may comprise, for example, a torsion spring or an appropriately-shaped flat spring. The ends of the spring 848 contact first stops 850 formed inside the bottom base plate 830. Second similar stops 852 are formed inside the top base plate 832. When the top plate 832 rotates in either the clockwise or counterclockwise direction, one pair of the second stops 852 contacts and deflects one side of the spring 848, which urges the top plate 832 back to its normal resting position. To prevent the top plate 832 from rotating more than 90 degrees, a limit stop 854 is formed on the inside of the bottom base plate 830.

Figure 16:
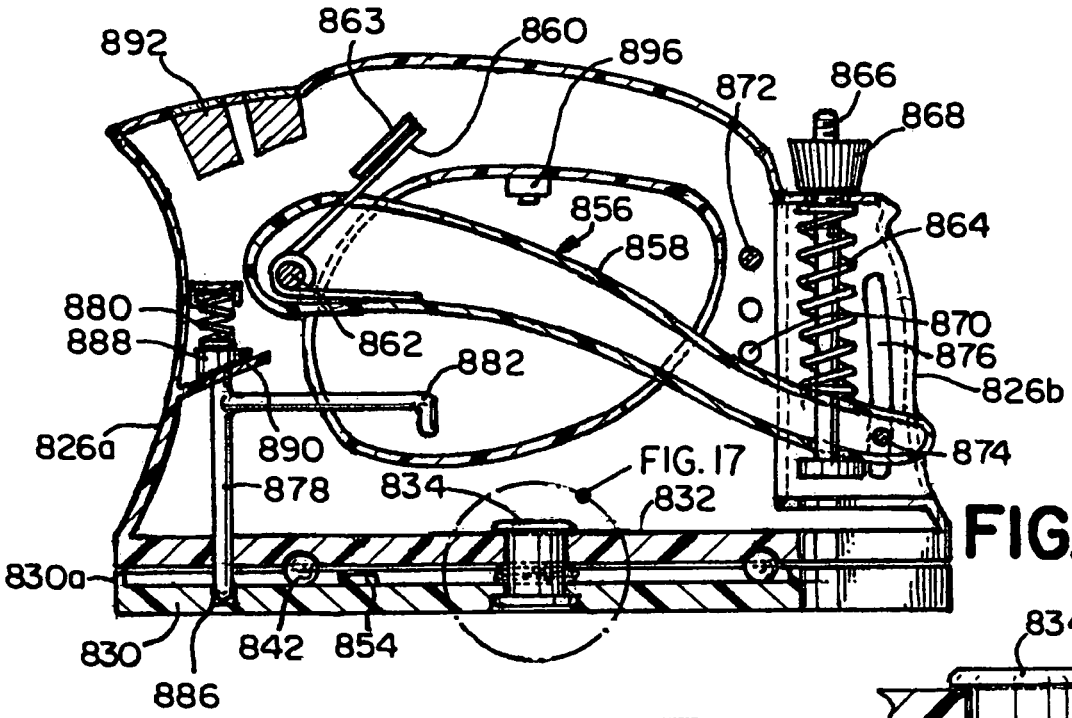
FIG. 16 is a cross-sectional view taken along lines 16-16 of FIG. 15.
Figure 17:
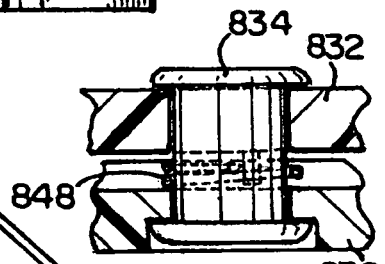
FIG. 17 is an enlarged, fragmentary view of the central shaft of the pushup device shown in FIG. 16.

The top base plate 832 can be locked in one of a plurality of angular positions relative to the bottom base plate 830. Referring to FIG. 16, the pushup device includes a retractable lock pin 878 mounted in the front support member 828*a*. The retractable pin 878 is normally biased downwardly by a compression spring 880. The retractable pin 878 extends through a pilot hole 884 in the top base plate 832, which is radially-aligned with a plurality of bores 886 in the bottom base plate 830. The top base plate 832 can be locked by allowing the retractable pin 878 to register with and engage one of the bores 886. To unlock the top base plate 832, the pin 878 is retracted by pulling upwardly on the finger handle 882, which can be locked in a retracted position by rotating the handle 882 in either direction. When the finger handle 882 is rotated, a cam 888 rides up a seat 890 and moves the pin 878 upwardly. The pin 878 remains retracted until the user rotates the pin 878 back to the resting position shown in FIG. 16.

The pushup device 810 includes a hand clutch 856, which enables the user to simultaneously perform pushups and hand-grip exercises. In the embodiment shown in FIGS. 13-20, the hand clutch 856 comprises a grip handle 858, which is pivotally-mounted at one end underneath the main handle 812 by a pivot pin 862, which extends through the front support member 826*a* and the front end of the clutch handle 858.

The grip handle 858 is normally biased by two springs in a downward direction to the position best seen in FIGS. 14 and 16. The first spring preferably comprises a torsion spring 860, which surrounds the pivot pin 862. As best seen in FIG. 16, one end of the torsion spring 860 abuts the grip handle 858 while the other free end abuts a stop 863 in the main handle 812.

The second spring preferably comprises a compression spring 864 seated in the back support member 826*b*. The compression spring 864 is mounted on the shank of a partially-threaded fastener 866. As best seen in FIGS. 15 and 16, the threaded fastener 866 resembles a carriage bolt. A knob 868 on the threaded end can be rotated to adjust the tension on the compression spring 864, thereby adjusting the amount of force required to pull the grip handle 858 upwardly. The compression spring 864 can be removed completely, or replaced with a compression spring having a different stiffness, to make the hand-grip exercise easier or more difficult. The compression spring 864 is removed/replaced by unscrewing the knob 868 and allowing the fastener 866 to drop down through the notches 831, 833 in the bottom and top base plates 830, 832, respectively. A cover, not shown, may be provided to conceal the compression spring to increase safety and aesthetics.

The grip handle 858 can be moved between limit positions by pulling upwardly and then relaxing the fingers. To adjust the limit positions, three pin holes 870 pass through the back support member 826*b*. A pin 872 can be inserted in any one of the holes 870 to limit the range of motion of the grip handle 858. In a preferred embodiment, the free end of clutch handle 858 includes a guide pin 874 which travels in an elongate slot 874 in the back support member as best shown in FIGS. 14 and 16.

The pushup device 810 also preferably includes a counter 892 that displays a variety of data relating to the user's exercise session. For example, the counter 892 may display the number of repetitions of each exercise, or the amount of time expended or remaining in an exercise session. To register a pushup, the user depresses a counter button 894 located on the front support member 826*a* within easy reach of the user's thumb as best seen on FIG. 13. Hand-grip and rotation exercise repetitions are automatically detected by a first sensor 896, shown in FIG. 16, and second sensor 898, shown in FIG. 18. The button 894 and sensors 896, 898 electronically communicate with the counter 892.

The counter 892 is preferably powered by a battery that can be recharged by connecting to an AC/DC converter. An LED may be provided to indicate when the battery requires charging. The counter may also include an interface that enables the counter data to be downloaded to the user's personal computer.

Figure 21:
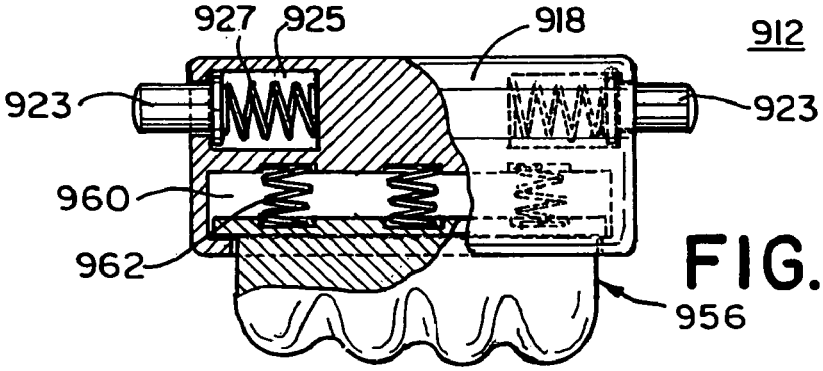
FIG. 21 is a side elevational view in partial section of a replaceable handle for use on a pushup device in accordance with embodiments of the invention.
Figure 22:
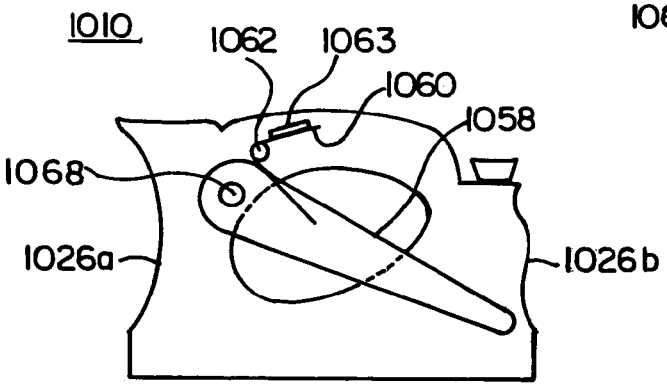
FIG. 22 is a schematic view of a further embodiment of the pushup device having a replaceable clutch handle.

In yet another embodiment shown in FIG. 21, a replaceable handle 912 having a hand clutch 956 for use with embodiments of the pushup device is shown in FIGS. 1-8. The hand clutch 956 has a main handle core 918 and a pair of support pins 923 fixed to opposed ends of the core 918. The pins 923 are retractable and have quick a connect/disconnect construction, which enables quicker attachment of the handle 612 to the support arms than the threaded fasteners described above. Referring to FIG. 21, each pin 923 retracts into and extends out from an axial socket 925 in the core 918. The pin 923 is normally biased outwardly to an extended position by an internal compression spring 927.

The hand clutch 956 comprises a grip handle 958 having a contour that can be comfortably gripped with the user's fingers. The grip handle 958 retracts into and extends out from a cavity 960 within the main handle core 918. The grip handle 958 is normally biased outwardly to an extended position by a plurality of internal compression springs 962.

Figure 23:
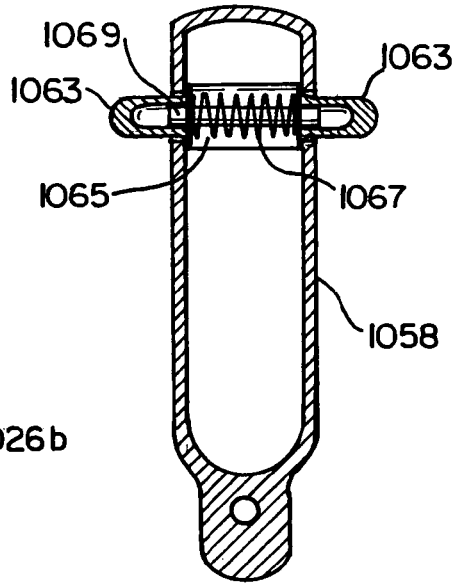
FIG. 23 is a top plan view of the clutch handle with retractable mounting pins shown in FIG. 22; and, FIGS. 24 and 25 are side elevational views of replaceable clutch handles for use on the pushup device in accordance with embodiments of the invention.

In yet a further embodiment shown in FIGS. 22-25, the pushup device 1010 has a construction similar to the pushup device 810 described above and shown in FIGS. 13-20. However, in this embodiment, the grip handle 1058 is quickly removable and replaceable with another grip handle having a different size or shape, such as the grip handles shown in FIGS. 24 and 25. Referring to FIG. 23, the handle

1058 is pivotally mounted by opposed pins 1063, which retract into and extend out from a cavity 1065 within the handle 1058. The pins 1063 are normally biased outwardly to an extended position shown in FIG. 23 by an internal compression spring 1067.

In this embodiment, a torsion spring 1060 is mounted on a separate axis 1062. The free ends of the torsion spring 1040 abut a stop 1063 inside the handle and the surface of the handle 1058.

Figure 24:
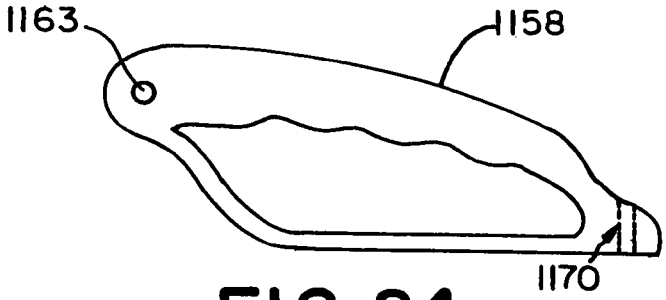
Figure 25:
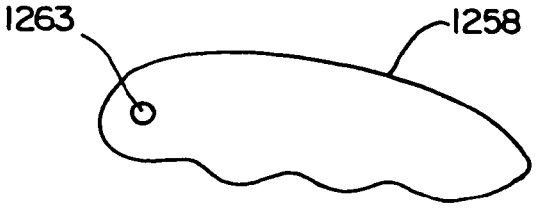

The handles 1158 and 1258 shown in FIGS. 24 and 25 are examples of the different shapes and sizes of handle that can be interchanged with the pushup device. For example, the handle 1258 shown in FIG. 25 is shorter than the grip handle 1058 shown in FIG. 22 and grip handle shown in FIG. 24. The handle 1258 is not long enough to engage the compression spring 864 and is therefore only biased by the torsion spring 1060. IN contrast, the grip handle 1158 of FIG. 24 includes an aperture 1170 through which the threaded shaft extends to secure the compression spring.

Similar to the embodiments described with reference to FIGS. 1-12, the embodiments described with reference to FIGS. 11-24 are generally used in pairs by initially placing the devices on the floor or other support surface. The user then grasps the main handles to perform pushups. During the exercise, the user can easily and smoothly rotate his hands about a vertical axis relative to the floor due to the bearing assembly within the base. The user can also simultaneously perform hand grip exercixes by squeezing and relaxing the grip handles. The user can thereby stretch and condition the numerous additional muscles in the manner normally achieved by performing traditional pushups.

While the principles of the invention have been described above in connection with specific embodiments, it is to be clearly understood that this description is made only by way of example and not as a limitation on the scope of the invention. For example, the structural features of the numerous embodiments described can be interchanged in many ways to provide additional embodiments.

The invention claimed is:

1. A device for performing pushups on a surface, comprising:

a) a main handle having first and second ends, and a grip portion;

b) a base having a bottom portion constructed to contact the surface, a top portion rotatably connected to said bottom portion, and a bearing assembly supporting said top portion on said bottom portion;

c) a support connecting said main handle to said top portion and supporting said handle at an elevated position relative to said base and above the surface;

d) a hand clutch that can be grasped and moved between first and second limit positions by squeezing with the user's fingers; and e) hand clutch bias means for resisting movement of said hand clutch from the first limit position to the second limit position.

2. The device recited in claim 1, wherein said main handle is constructed and arranged to support the user's palm and the hand clutch can be squeezed by the user's fingers when the user assumes a pushup exercise position.

3. The device recited in claim 1, wherein said hand clutch bias means can be adjusted to change the force needed to move the clutch between limit positions.

4. The device recited in claim 1, wherein said hand clutch is pivotally-connected to said handle, and said clutch bias means normally urges the hand clutch away from said handle.

5. The device recited in claim 3, wherein said clutch bias means includes a spring tensioner and at lease one of a compression spring and torsion spring.

6. The device recited in claim 1, including means for adjusting at least one of said limit positions.

7. The device recited in claim 1, wherein each of said top and bottom base portions comprises a generally-planar base plate connected by a central shaft and arranged facing one another, said plates defining an internal cavity intermediate said plates.

8. The device recited in claim 7, including bearings arranged in said internal cavity, said bearings separating and supporting said top plate relative to said bottom plate.

9. The pushup device recited in claim 1, wherein said main handle is removable from said support.

10. The pushup device recited in claim 1, including a second main handle that can be interchanged with said first main handle, said second main handle having a grip portion that is different than the grip portion of said first main handle.

11. The pushup device recited in claim 10, wherein said first and second main handles include a quick connect/disconnect fastener.

12. The pushup device recited in claim 1, including an angular position indicator for measuring angular rotation of said handle relative to said bottom portion of said base.

13. The pushup device recited in claim 1, including a base bias means for resisting rotational movement of said top base in either a clockwise or counter-clockwise direction.

14. The pushup device recited in claim 13, including an adjustable stop for locking said top base plate in at least one predetermined angular location.

15. The pushup device recited in claim 1, wherein said main handle, support and hand clutch are removable from said base.

16. The pushup device recited in claim 1, wherein said main handle is removable from said support, and said support is freely collapsible when said main handle is disconnected from said support.

17. The pushup device recited in claim 1, wherein said hand clutch includes a grip handle is removable and can be interchanged with a second grip handle having a different shape or size.

18. The pushup device recited in claim 17, wherein said grip handles include quick connect/disconnect fasteners.

19. The pushup device recited in claim 1, including a counter for recording and displaying the number of exercise repetitions performed by the user.

20. The pushup device recited in claim 19, including an interface on said counter for downloading data from said counter to the user's computer.

* * * * *